US007104772B2

(12) United States Patent
Tsuboi

(10) Patent No.: US 7,104,772 B2
(45) Date of Patent: Sep. 12, 2006

(54) SCREW COMPRESSOR

(75) Inventor: Noboru Tsuboi, Kako-gun (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/687,630

(22) Filed: Oct. 20, 2003

(65) Prior Publication Data

US 2004/0086409 A1 May 6, 2004

(30) Foreign Application Priority Data

Nov. 1, 2002 (JP) ..... 2002-319479

(51) Int. Cl.
*F01C 1/16* (2006.01)

(52) U.S. Cl. ..... 418/201.1; 418/98; 418/104; 418/DIG. 1; 384/303; 384/453; 384/504; 384/609; 384/613

(58) Field of Classification Search ..... 418/201.1, 418/98, 97, 104, DIG. 1, 203; 384/303, 453, 384/504, 609, 613
See application file for complete search history.

(56) References Cited

U.S. PATENT DOCUMENTS

| | | | | | |
|---|---|---|---|---|---|
| 3,307,777 | A | * | 3/1967 | Lauritz | 418/201.1 |
| 3,388,854 | A | * | 6/1968 | Hans et al. | 418/203 |
| 3,535,057 | A | * | 10/1970 | Esper | 418/201.1 |
| 4,557,679 | A | * | 12/1985 | Mori et al. | 418/201.1 |
| 4,730,995 | A | | 3/1988 | Dewhirst | |
| 5,281,115 | A | * | 1/1994 | Timuska | 418/9 |
| 5,655,844 | A | * | 8/1997 | Takano | 384/453 |
| 5,707,223 | A | | 1/1998 | Englund et al. | |
| 5,979,168 | A | * | 11/1999 | Beekman | 418/201.2 |
| 6,183,227 | B1 | | 2/2001 | Hida et al. | |
| 6,416,302 | B1 | * | 7/2002 | Achtelik et al. | 418/201.1 |

FOREIGN PATENT DOCUMENTS

| | | | |
|---|---|---|---|
| JP | 57-153986 | | 9/1982 |
| JP | 05010283 | A * | 1/1993 |
| JP | 06173871 | A * | 6/1994 |
| JP | 11210653 | A * | 8/1999 |

* cited by examiner

*Primary Examiner*—Theresa Trieu
(74) *Attorney, Agent, or Firm*—Oblon, Spivak, McClelland, Maier & Neustadt, P.C.

(57) ABSTRACT

In a screw compressor for a refrigerator, suction-side rotor shafts of screw rotors are supported rotatably by angular ball bearings for forward thrust load, an annular gap is formed between the angular ball bearings and a suction-side bearing casing, and outermost end faces of outer rings of the angular ball bearings are pressed through a spring member by means of a presser member fixed to an end face of the suction-side bearing casing, whereby the angular ball bearings are held movably in the thrust direction within the suction-side bearing casing. Discharge-side rotor shafts of the screw rotors are supported rotatably by angular ball bearings for forward thrust load and an angular ball bearing for reverse thrust load which are held at predetermined certain positions within a discharge-side bearing casing. A screw compressor which permits structural simplification, reduction of size, and lightening of a maintenance burden is provided.

9 Claims, 4 Drawing Sheets

SCREW COMPRESSOR

BACKGROUND OF THE INVENTION

1. Field of the Invention

The present invention relates to a screw compressor and more particularly to a screw compressor for compressing a refrigerant in a refrigerator.

2. Description of the Related Art

Heretofore, a screw compressor applicable to a refrigerator has been publicly known (see, for example, U.S. Pat. No. 6,183,227).

Screw compressors are broadly classified into an oil-cooled type screw compressor and an oil-free type screw compressor. In an oil-cooled type screw compressor, oil is fed into a rotor chamber for the purpose of sealing between rotors, sealing between rotors and an inner wall surface of the rotor chamber, cooling a portion whose temperature rises with compression, and lubrication. In an oil-free type screw compressor, oil is not fed into a rotor chamber, a bearing portion is completely shut off from the rotor chamber by sealing, and a synchronous gear is used for the transfer of a rotational drive force between male and female rotors. As to the structure of the compressor body itself, the oil-free screw compressor is more complicated than the oil-cooled screw compressor. At the same discharge air volume, the oil-free screw compressor is more expensive, correspondingly to the more complicated structure thereof, than the oil-cooled screw compressor. Further, the gap between rotors and the gap between the rotors and an inner wall surface of the rotor chamber are larger in the oil-free screw compressor than in the oil-cooled screw compressor. The amount of gas leaking through those gaps is also larger in the oil-free screw compressor. Generally, therefore, the oil-cooled screw compressor is used and the oil-free screw compressor is not used except in such a special use as requires only a clean compressed gas without permitting the inclusion of lubricating oil in the compressed gas.

In U.S. Pat. No. 6,183,227 is disclosed an oil-cooled screw compressor 30 which is illustrated in FIG. 4. The screw compressor 30 has a pair of intermeshing male and female screw rotors 32 and a motor 33 within an integral type casing 31. At one end of the integral type casing 31 is formed a gas inlet 35 which is provided with a filter 34. At an end portion of the screw rotors 32 located close to the motor 33 is formed a suction port 36, while at an opposite end portion thereof is formed a discharge port 37.

Suction-side rotor shafts 41 of the screw rotors 32 are supported within a suction-side bearing casing 42 rotatably by two cylindrical roller bearings 43*a* and 43*b* for radial load whose outer rings are held at predetermined certain positions through an appropriate spacing. Discharge-side rotor shafts 44 of the screw rotors 32 are arranged within a discharge-side bearing casing 45 so as to be in close contact with each other and are supported rotatably by one cylindrical roller bearing 46 for radial load whose outer ring is held at a predetermined certain position, two angular ball bearings 47*a* and 47*b* for forward thrust load, and one angular ball bearing 48 for reverse thrust load. As to the thrust loads, the direction from the suction side toward the discharge side is assumed to be a reverse direction, while the direction from the discharge side toward the suction side is assumed to be a forward direction.

The suction-side rotor shaft 41 of one of the paired male and female screw rotors 32 shown in FIG. 4 is coupled for integral rotation to an output shaft 49 of the motor 33, and the screw rotors 32 are rotated by the motor 33. Since the screw compressor 30 is an oil-cooled type, oil is fed through an oil flow path (not shown) to each of the bearing portion within the suction-side bearing casing 42, the bearing portion within the discharge-side bearing casing 45, and a tooth space not communicating with the discharge port 37 of the screw rotors 32.

When the screw compressor 30 is applied to a refrigerator, a gaseous refrigerant which has entered the screw compressor 30 from the gas inlet 35 through the filter 34 passes the motor 33 and is sucked from the suction port 36 into the tooth space of the screw rotors 32 which are rotating, whereby it is compressed under the supply of oil. The thus-compressed gaseous refrigerant together with oil is discharged from the discharge port 37 to an oil separating/recovering unit, in which the refrigerant and the oil are separated from each other. The refrigerant then passes through a condenser and is conducted to an expansion valve and an evaporator. On the other hand, the oil which has been separated from the refrigerant is once stored in an oil sump and is then fed through the foregoing oil flow path to the bearing portion within the suction-side bearing casing 42, the bearing portion within the discharge-side bearing casing 45, and the tooth space not communicating with the discharge port 37 of the screw rotors 32. The oil is recycled repeatedly.

In the screw rotors 32, a radial load is imposed on each of the suction side and the discharge side and it is borne by the suction-side cylindrical roller bearings 43*a*, 43*b* and the discharge-side cylindrical roller bearing 46. Further, due to a pressure difference between the suction side and the discharge side, a forward thrust load acts on the screw rotors 32 from the discharge side toward the suction side, and the screw rotors 32 undergo a thermal expansion caused by the compression of gas and the resulting rise of temperature. However, the discharge-side rotor shafts 44 are restrained its movement in the thrust direction by the two angular ball bearings 47*a*, 47*b* for forward thrust load and one angular ball bearing 48 for reverse thrust load.

On the other hand, the suction-side rotor shafts 41 are merely supported by the cylindrical roller bearings 43*a* and 43*b* which permit free movement in the thrust direction of outer rings relative to inner rings, and their movement in the thrust direction is not restrained at all. Therefore, in the event of thermal expansion of the screw rotors 32, the suction-side rotor shafts 41 move relatively in the thrust direction with respect to the suction-side bearing casing 42. In these cases, it is the oil that ensures a smooth movement in each bearing.

As described above, the structure of the screw compressor body itself is simpler in the oil-cooled type than in the oil-free type, but in the case of an oil-cooled screw compressor, not only it is necessary to use an oil separating/recovering unit and, as the case may be, an oil cooler and an oil filter, but also an oil flow path including these devices is needed. As an additional problem, maintenance of those devices and the management of oil are required. That is, in case of applying an oil-cooled screw compressor to a refrigerator, it is necessary to provide an oil flow path for the recycle of oil, in addition to the refrigerant recycle path.

It is ideal if an oil-cooled screw compressor having a simple structure and not requiring the use of oil is applied to a refrigerator, but even if such a screw compressor is adopted, it is necessary to use liquid as a substitute for oil.

In this connection, reference will be made below to the case where a portion of the liquid refrigerant after condensation in the condenser and before reaching the expansion valve is used as a substitute for the oil in the screw compressor 30 shown in FIG. 4.

In the screw compressor 30, the cylindrical roller bearings 43*a* and 43*b* are used for the suction-side rotor shafts 41, while the cylindrical roller bearing 46 is used for the discharge-side rotor shafts 44. In these bearings, cylindrical rollers are in linear contact with inner and outer rings, so it is difficult to effect lubrication using a refrigerant. More specifically, in the case of an angular ball bearing, balls are in point contact with inner and outer rings, so by allowing a liquid refrigerant to be present in the point contact portions it is possible to lubricate between the balls and the inner and outer rings. But in the case of a cylindrical roller bearing, it is difficult to make a liquid refrigerant of a lower viscosity than oil be present in linear contact portions between cylindrical rollers and the inner and outer rings, with consequent insufficient lubrication giving rise to a problem of seizure of the cylindrical roller bearing.

SUMMARY OF THE INVENTION

For the purpose of eliminating the above-mentioned conventional problems, the present invention intends to provide a screw compressor which permits structural simplification, reduction of size, and lightening of a maintenance burden.

For solving the above-mentioned problems, in a first aspect of the present invention, there is provided a screw compressor comprising screw rotors, suction-side rotor shafts of the screw rotors, a suction-side bearing casing which covers the suction-side rotor shafts, a suction-side angular ball bearing which rotatably supports the suction-side rotor shafts and is held so as to be movable in a thrust direction within the suction-side bearing casing, discharge-side rotor shafts of the screw rotors, a discharge-side bearing casing which covers the discharge-side rotor shafts, and a discharge-side angular ball bearing which rotatably supports the discharge-side rotor shafts and is held in a predetermined certain position within the discharge-side bearing casing.

In a second aspect of the present invention, there is provided, in combination with the construction of the above first aspect, a screw compressor further comprising a presser member fixed to an end face of the suction-side bearing casing and a spring member, wherein an annular gap is formed between the suction-side bearing casing and the suction-side angular ball bearing, and an outermost end face of an outer ring of the suction-side angular ball bearing is pressed through the spring member by means of the presser member.

Therefore, in this screw compressor, a condensed refrigerant can be fed into a liquid state to bearing portions and can be utilized for lubrication and sealing, thus eliminating the need of using oil. As a result, all of oil-related devices, including oil separating/recovering unit, and oil pipes, that have so far occupied a fairly large proportion in such points as structural complication, increase of the entire machine volume and installation area, and increase of cost, become unnecessary and the entire machine structure is simplified and is reduced in size. In addition, oil-related maintenance works and the management of oil, which have so far been a burden in the use of oil, become unnecessary. Thus, various effects are obtained.

In a third aspect of the present invention, there is provided, in combination with the construction of the above first or second aspect, a screw compressor wherein a lubricative coating is applied to an inner periphery surface of the suction-side bearing casing.

With this construction, in addition to the above effects, there is attained an effect that it is possible to cope with a thermal expansion of screw rotors more smoothly.

DESCRIPTION OF THE PREFERRED EMBODIMENTS

An embodiment of the present invention will be described below with reference to the drawings.

Figure 1:
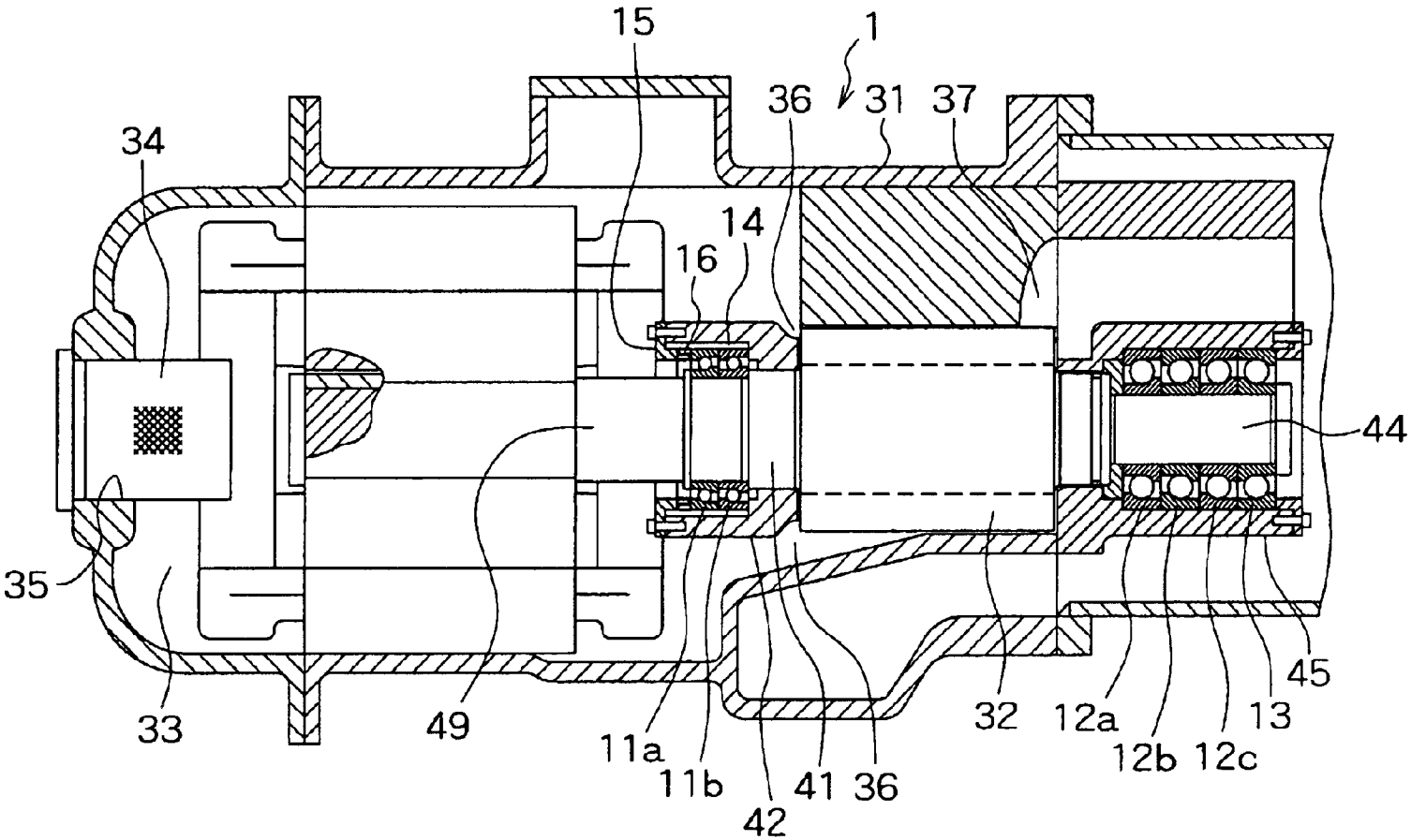
FIG. 1 is a sectional view of a screw compressor for a refrigerator according to the present invention.
Figure 2:
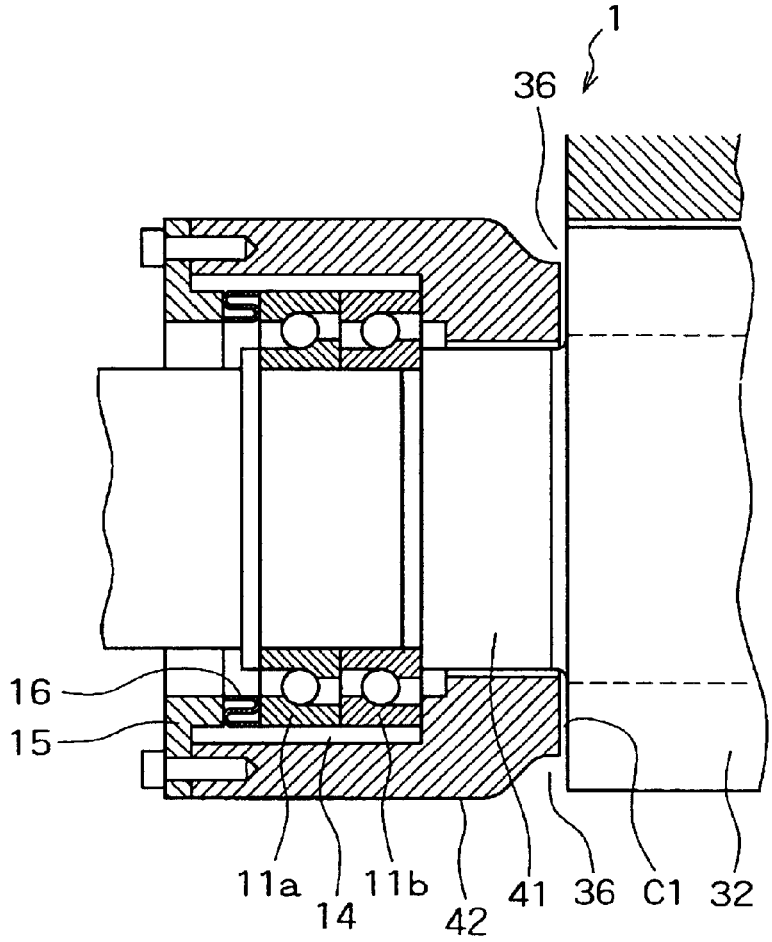
FIG. 2 is a partial enlarged sectional view of a suction-side bearing portion in the screw compressor shown in FIG. 1.
Figure 3:
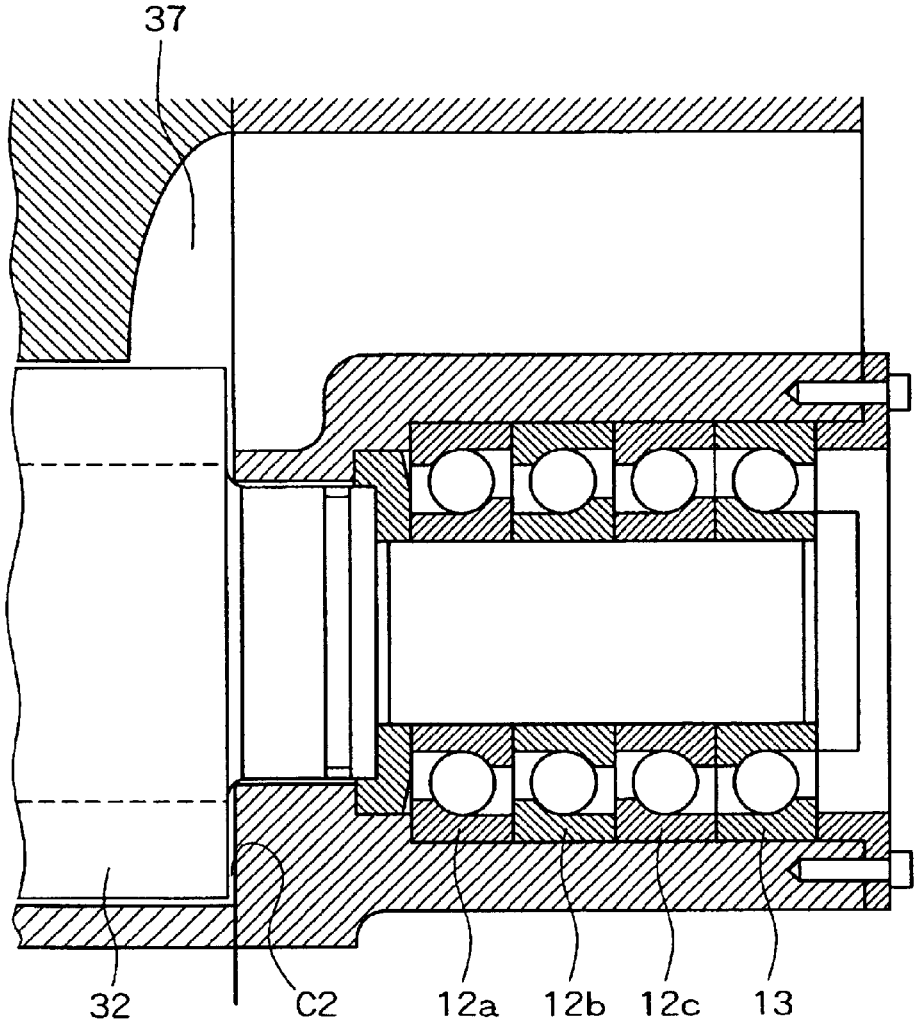
FIG. 3 is a partial enlarged sectional view of a discharge-side bearing portion in the screw compressor shown in FIG. 1.
Figure 4:
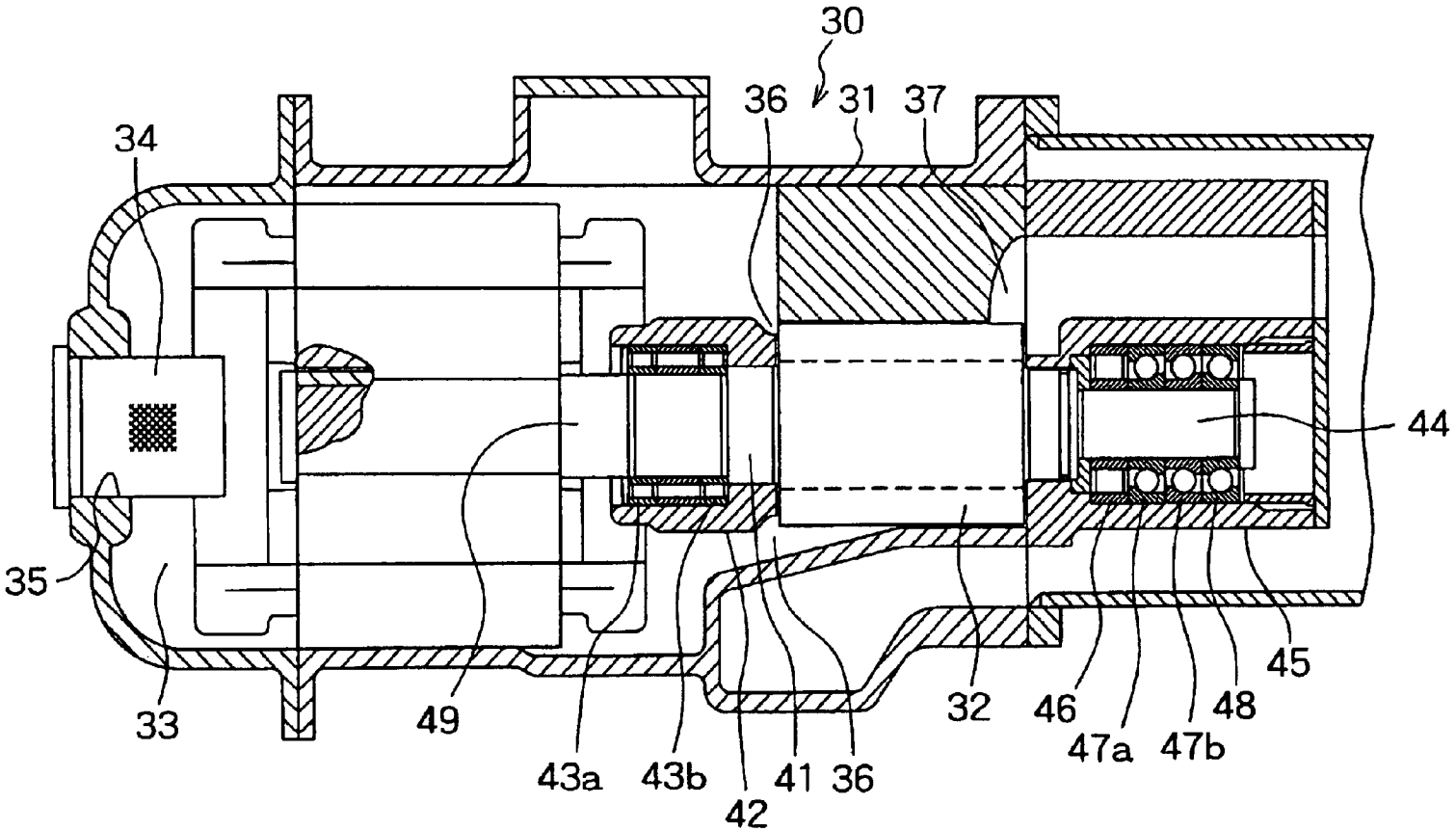
PRIOR ART FIG. 4
FIG. 4 is a sectional view of a conventional oil-cooled screw compressor.

FIGS. 1 to 3 illustrate a screw compressor 1 for a refrigerator according to the present invention.

The screw compressor 1 has a pair of intermeshing male and female screw rotors 32 and a motor 33 within an integral type casing 31. At one end of the integral type casing 31 is formed a gas inlet 35 which is provided with a filter 34. At an end portion of the screw rotors 32 located close to the motor 33 is formed a suction port 36, while at an opposite end portion thereof is formed a discharge port 37.

The suction-side rotor shaft 41 of one of the paired male and female screw rotors 32 shown in FIG. 1 is coupled for integral rotation to an output shaft 49 of the motor 33, and the screw rotors 32 are rotated by the motor 33.

When the screw compressor 1 is applied to a refrigerator, a gaseous refrigerant which has entered the screw compressor 1 from the gas inlet 35 through the filter 34 passes the motor 33 and is sucked from the suction port 36 into the tooth space of the screw rotors 32 which are rotating, whereby it is compressed. The thus-compressed gaseous refrigerant is discharged from the discharge port 37. The refrigerant then passes through a condenser and is conducted to an expansion valve and an evaporator.

In the screw compressor 1, oil is not fed to the gas to be compressed. Instead of oil, a liquid refrigerant is used for bearing lubrication.

In the screw compressor 1, suction-side rotor shafts 41 are supported rotatably by two angular ball bearings 11*a* and 11*b* for forward thrust load, while discharge-side rotor shafts 44 are supported by three angular ball bearings 12*a*, 12*b*, 12*c* for forward thrust load and one angular ball bearing 13 for reverse thrust load. On both suction side and discharge side, the number of the angular ball bearings for forward thrust load and that of the angular ball bearing for reverse thrust load are not limited. The respective numbers referred to above may be changed.

Inner rings of the angular ball bearings 11*a* and 11*b* for forward thrust load are fixed to predetermined certain positions on the suction-side rotor shafts 41, and an annular groove 14 is formed between outer rings of the angular ball bearings 11*a*, 11*b* for forward thrust load and an inner periphery surface of a suction-side bearing casing 42. The annular groove 14 is formed as a very small gap (for example, 0.02 to 0.05 mm) to such an extent as causes no obstacle to substantial operation of screw rotors 32 even under a radial load on the suction side. Thus, the outer rings of the angular ball bearings 11*a* and 11*b* for forward thrust load are movable relative to the inner periphery surface of the suction-side bearing casing 42. Further, an annular presser member 15 is fixed to an end face of the suction-side bearing casing 42, and outermost end faces of the outer rings of the angular ball bearings 11*a* and 11*b* for forward thrust load are pressed by the presser member 15 through a spring member 16. As a result, the angular ball bearings 11*a* and 11*b* for forward thrust are held movably in the thrust direction while undergoing a spring force in the direction toward the screw rotors 32 constantly in the suction-side bearing casing 42. The shape of the spring member 16 is not limited to the illustrated one, but may be any other shape insofar as the spring member is formed of a material having resilience.

Inner rings of three angular ball bearings 12*a*, 12*b*, 12*c* for forward thrust load and one angular ball bearing 13 for reverse thrust load, which are located on the discharge side, are fixed to predetermined certain positions on the discharge-side rotor shafts 44, while outer rings thereof are fixed to predetermined certain positions of an inner periphery surface of a discharge-side bearing casing 45. Thus, the angular ball bearings 12*a*, 12*b*, 12*c* for forward thrust load and the angular ball bearing 13 for reverse thrust load are held at predetermined certain positions within the discharge-side bearing casing 45 and a relative movement of the discharge-side rotor shafts 44 with respect to the discharge-side bearing casing 45 is restrained.

Gaps are also formed respectively at suction- and discharge-side end faces of the screw rotors 32. For example, a gap C1 of about 0.2 mm is formed at the suction-side end face and a gap C2 of about 0.05 mm is formed at the discharge-side end face.

In the screw compressor 1 constructed as above, all of the bearings used are angular ball bearings, thus permitting lubrication of the bearings with use of a liquid refrigerant. Further, even in the event of thermal expansion of the screw rotors 32, the expansion is absorbed by the movement in the thrust direction of the suction-side angular ball bearings 11*a* and 11*b* for forward thrust load.

As known well, each of the angular ball bearings described above can bear not only thrust load but also radial load.

The annular gap between the angular ball bearings 11*a*, 11*b* for forward thrust and the suction-side bearing casing 42 is very small. It is preferable that a lubricative coating, e.g., molbdenum disulfide coating or so-called Teflon coating, be applied to the inner periphery surface of the suction-side bearing casing 42.

Thus, the screw compressor 1 permits substitution of oil by a liquid refrigerant for bearing lubrication, and when it is applied to a refrigerator, it becomes unnecessary to use oil-related devices, including oil separating/recovering unit, and maintenance thereof and the management of oil are not required.

What is claimed is:

1. A screw compressor comprising:

screw rotors;

suction-side rotor shafts of said screw rotors;

a suction-side bearing casing, said suction-side bearing casing covering said suction-side rotor shafts;

a suction-side angular ball bearing, said suction-side angular ball bearing rotatably supporting said suction-side rotor shafts and being held so as to be movable in a thrust direction within said suction-side bearing casing, wherein there is no cylindrical roller bearing at said suction side rotor shafts;

discharge-side rotor shafts of said screw rotors;

a discharge-side bearing casing, said discharge-side bearing casing covering said discharge-side rotor shafts; and a discharge-side angular ball bearing, said discharge-side angular ball bearing rotatably supporting said discharge-side rotor shafts and being held immovably within said discharge-side bearing casing.

2. The screw compressor according to claim 1, further comprising:

a presser member fixed to an end face of said suction-side bearing casing; and a spring member, wherein an annular gap is formed between said suction-side bearing casing and said suction-side angular ball bearing, and an outermost end face of an outer ring of said suction-side angular ball bearing is pressed through said spring member by means of said presser member.

3. The screw compressor according to claim 1, wherein a lubricative coating is applied to an inner periphery surface of said suction-side bearing casing.

4. A compressor comprising:

at least one rotor provided on a rotor shaft rotatably mounted in a casing, whereby rotation of said rotor compresses a fluid in passage of the fluid from a suction side of said rotor shaft to a discharge side of said rotor shaft;

a suction-side rotor bearing comprising at least one angular ball bearing rotatably supporting said at least one rotor shaft at said suction side and being movable in a thrust direction, wherein there is no cylindrical roller bearing at said suction side rotor shafts; and a discharge-side rotor bearing comprising at least one angular ball bearing rotatably supporting said at least one rotor shaft at said discharge side and being held immovably in the thrust direction.

5. The compressor according to claim 4, further comprising means for lubricating at least one of said bearings using said fluid.

6. The compressor according to claim 4, further comprising means for pressing the suction-side rotor bearing in the thrust direction.

7. A compressor comprising:

means including at least one rotatably mounted rotor shaft for compressing a fluid in passage of the fluid from a suction side of said rotor shaft to a discharge side of said rotor shaft;

a suction-side rotor bearing comprising at least one angular ball bearing rotatably supporting said at least one rotor shaft at said suction side and being movable in a thrust direction, wherein there is no cylindrical roller bearing at said suction side; and a discharge-side rotor bearing comprising at least one angular ball bearing rotatably supporting said at least one rotor shaft at said discharge side and being held immovably in the thrust direction.

8. The compressor according to claim 7, further comprising means for lubricating at least one of said bearings using said fluid.

9. The compressor according to claim 7, further comprising means for pressing the suction-side rotor bearing in the thrust direction.

* * * * *

UNITED STATES PATENT AND TRADEMARK OFFICE

CERTIFICATE OF CORRECTION

PATENT NO. : 7,104,772 B2
APPLICATION NO. : 10/687630
DATED : September 12, 2006
INVENTOR(S) : Tsuboi It is certified that error appears in the above-identified patent and that said Letters Patent is hereby corrected as shown below:

On the title page, Item (73), the Assignee Information is incorrect. Item (73) should read:

-- (73) Assignee: Kabushiki Kaisha Kobe Seiko Sho
(Kobe Steel, Ltd.) Kobe (JP)--

Signed and Sealed this

Fourteenth Day of November, 2006

JON W. DUDAS
*Director of the United States Patent and Trademark Office*